United States Patent [19]

Korycki

[11] 4,306,422

[45] Dec. 22, 1981

[54] HEAT PUMP SYSTEM

[76] Inventor: Leszek S. Korycki, 170 Chalkfarm Dr., Apt. 1005, Downsview, Ontario, Canada, M3L 2H9

[21] Appl. No.: 159,601

[22] Filed: Jun. 16, 1980

[30] Foreign Application Priority Data

Dec. 31, 1979 [CA] Canada ..... 342812

[51] Int. Cl.[3] ..... F25B 13/00

[52] U.S. Cl. ..... 62/324.6; 137/625.43; 137/625.48

[58] Field of Search ..... 62/324.1, 324.7, 160, 62/324.6; 137/625.43, X, 625.29, 625.48

[56] References Cited

U.S. PATENT DOCUMENTS 3,527,256 9/1970 Colombo ..... 137/625.48
3,867,960 2/1975 Hosoda et al. ..... 137/625.43

FOREIGN PATENT DOCUMENTS 680472 2/1964 Canada .

*Primary Examiner*—Lloyd L. King
*Attorney, Agent, or Firm*—Ridout & Maybee

[57] ABSTRACT

A heat pump system having two heat exchangers, a condenser, and selective connecting means for connecting the heat exchangers to the compressor so that each can function alternately as an evaporator or as a condenser, without reversing the direction of flow of refrigerant through the heat exchanger.

2 Claims, 2 Drawing Figures

HEAT PUMP SYSTEM

Figure 1:
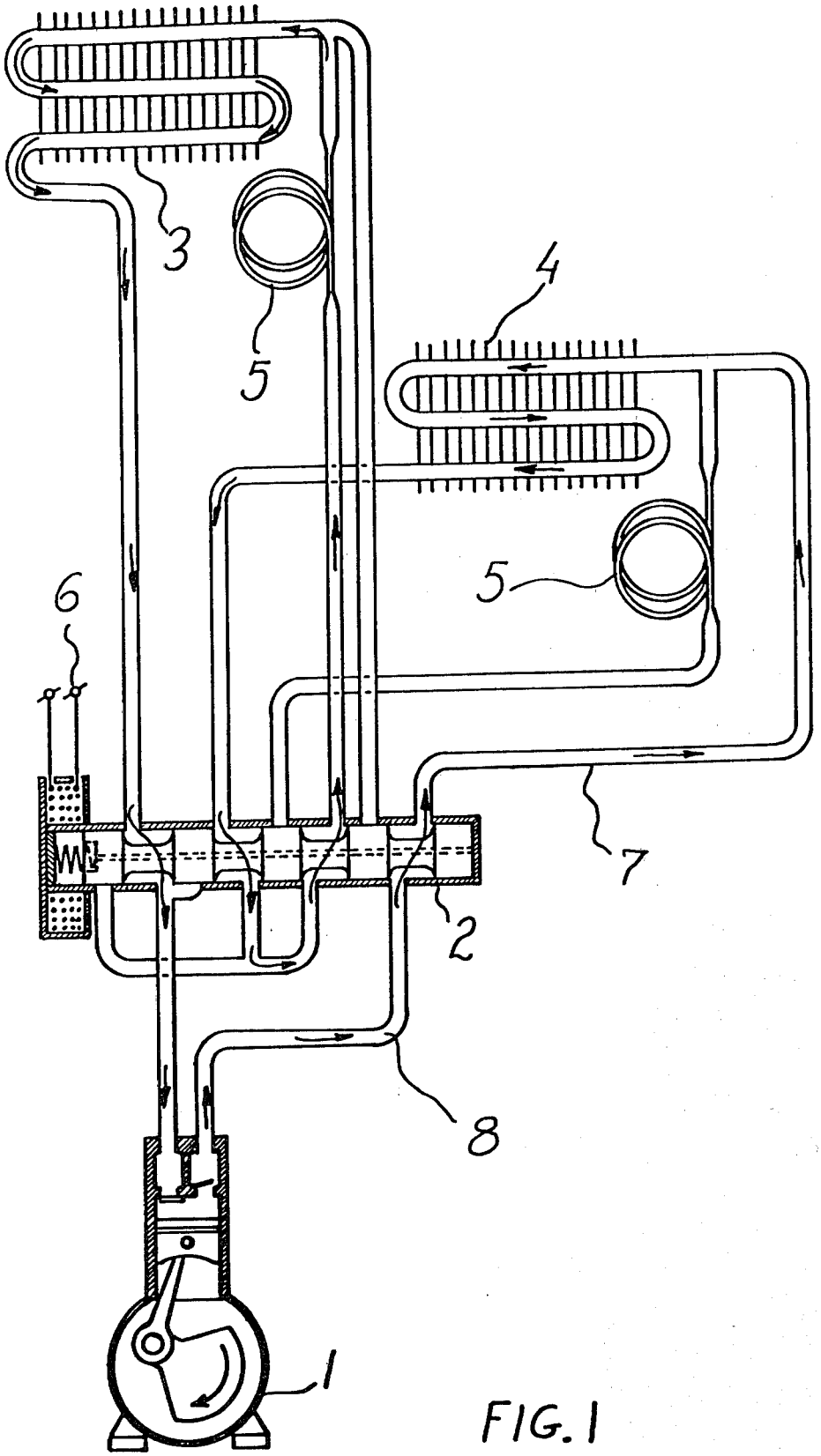

This invention relates to a heat pump system. The basic heat pump system is composed of a compressor, two heat exchangers, two expansion devices, an automatic reversing valve, piping and refrigerant circulating in the system. Presently, the automatic reversing valve usually used is a four-way two-position valve.

When the four-way valve is in one position, one heat exchanger works as an evaporator (heat absorber) and the other heat exchanger works as a condenser (heat discharger). When the four-way valve is in the other position, the said one heat exchanger works as a condenser (heat discharger) and the said other heat exchanger works as an evaporator (heat absorber). By switching the four-way valve between the two positions, the functions of the heat exchangers are reversed, but simultaneously the directions of the refrigerant flow within the two heat exchangers are also reversed.

With existing designs of heat exchangers efficient operation cannot be achieved when the refrigerant flow within the heat exchangers alternates in opposing directions. Essentially, in one of the directions of the refrigerant flow the heat exchanger is partially filled by liquid refrigerant (a dry heat exchanger). For the reversed refrigerant flow, the same heat exchanger is totally filled with liquid refrigerant (a flooded heat exchanger).

In existing designs of refrigeration systems there is a tendency to use dry heat exchangers because it is easier and cheaper to produce these systems and operate them. In the refrigeration system, the compressor discharges some oil together with the hot refrigerant gas and this oil circulates in the system with the refrigerant. It is essential to achieve proper oil return to the compressor, because if some oil is trapped in the system, it reduces the efficiency of the heat transfer, and, moreover, a sudden release of this oil can damage the compressor. When a heat exchanger operates as a dry evaporator, it has its inlet port, where the expansion device is attached, on a higher level and the outlet port, that is connected to the suction line of the compressor, on a lower level. This permits the forces of gravity to help the circulation of refrigerant and oil. The volume of refrigerant within the dry heat exchanger is moderate.

A flooded evaporator has its inlet on the bottom and all pipes are filled by the liquid refrigerant, with only the highest part of the evaporator pipes containing a foamy mixture of oil-refrigerant. It is difficult to control the flow of oil when the volume of refrigerant within the evaporator is significantly larger.

A dry condenser has its inlet port on the top and the outlet port on the bottom. Condensing refrigerant flows down by gravity forces. Oil with refrigerant flows together downward through the condenser and cannot be contained or stored inside the condenser.

A flooded condenser has its inlet port on the bottom and its outlet port on the top. Oil is mixed with the refrigerant and is trapped within the condenser. Liquid refrigerant is pressured upward by the hot gas creating a foaming-bubbling action and the volume of refrigerant and oil within the condenser is not controlled.

Unfortunately presently designed heat pumps reverse the flows of refrigerant, which means alternating the application of the heat exchangers from dry to flooded. I have found that these disadvantages may be overcome by providing a heat pump comprising: a compressor for refrigerant gas; a first heat exchanger having an inlet and an outlet; a first pair of conduits connected to said first heat exchanger inlet, one of said conduits containing an expansion device for refrigerant fluid travelling therein toward said first heat exchanger; a second heat exchanger having an inlet and an outlet; a second pair of conduits connected to said second heat exchanger inlet, one of said conduits containing an expansion device for refrigerant fluid travelling therein toward said second heat exchanger; and means for selectively connecting: the outlet of said compressor to the other conduit to a selected one of said heat exchangers; and the outlet of the other of said heat exchangers to the input of said compressor, while connecting the outlet of said selected heat exchanger to the conduit containing the expansion device at the inlet of the other heat exchanger while closing the then unused conduit connected to each heat exchanger inlet, said selective connecting means including means for reversing the roles of the heat exchangers.

Both heat exchangers in this system have three connections, and the direction of the refrigerant flow now remains identical in both heat exchangers for any position of the selective connecting means, and both heat exchangers can be operated as dry heat exchangers in both positions of the selective connecting means. This corrects the problem of oil return and the system can be arranged so that the amounts of refrigerant circulating in the system are well balanced.

Figure 2:
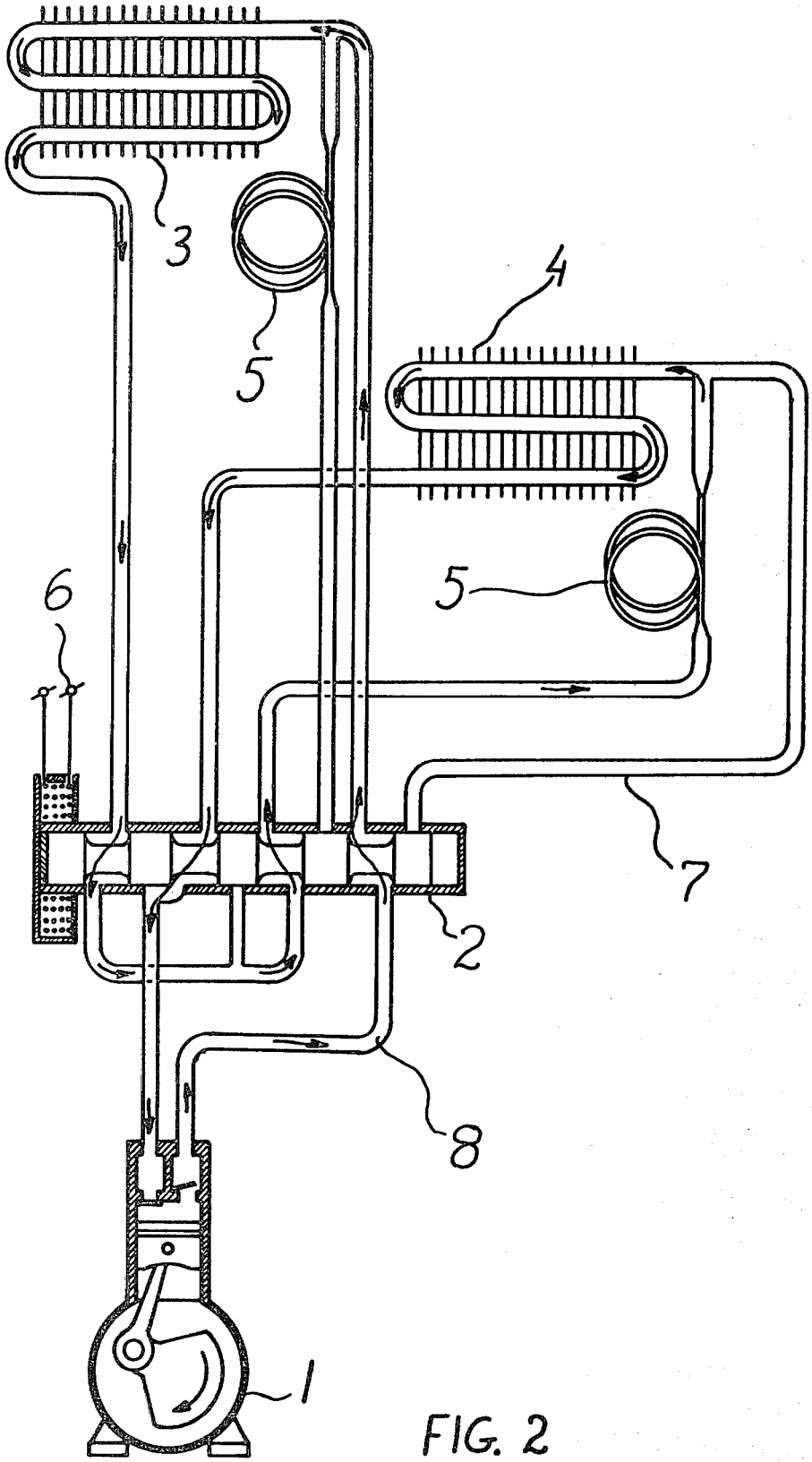

In the accompanying drawings which illustrate a preferred embodiment of the invention:

FIG. 1 is a view of a three pipe heat pump system with an eight-way valve in a first selective connecting position; and FIG. 2 shows the system of FIG. 1 with the valve in the other selective connecting position.

In the drawings a conventional compressor 1 feeds refrigerant to a distributing valve 2 along a pipe 8. As is clearly shown in the drawings within the valve 2 is a two-position valve stem, which is biased, rightwards in the drawings, by spring force. A solenoid coil, energizable by applying a potential across its terminals 6, can be used to shift the valve stem leftwardly in the figures, to the position shown in FIG. 2. In the position of the valve shown in FIG. 1, the heat exchanger 3 is a coil positioned inside of the building and is working as an evaporator cooling the inside air. The heat exchanger 4 is a coil positioned outside of the building and is working as a condenser. The directions of the circulating refrigerant in the piping system are marked by arrows inside pipes. Compressor 1 is driven by a motor and compresses the vapour refrigerant to a condensing pressure and temperature. At that condition the refrigerant, as the arrows illustrate, enters the valve 2 where it is directed along pipe 7 to the heat exchanger 4, where it condenses and discharges heat to the outside air. Now condensed, the liquid refrigerant is directed by the piping system back to the valve 2, where it is directed as marked by the arrows to the expansion device 5 upstream of the heat exchanger 3. In the expansion device 5, the refrigerant pressure is reduced to an evaporating pressure and the temperature drops to evaporating temperature. The refrigerant in the evaporating condition enters the heat exchanger 3, where it evaporates, absorbing heat from air inside the building, providing a cooling effect. The evaporated refrigerant now travels by the piping system to the valve 2 from where it is directed to the suction pipe of the compressor 1 and the cycle is repeated.

FIG. 2 is a view of the same system with the valve 2 whose solenoid coil is now energized by electrical current on the terminals 6. This creates a magnetic force drawing the stem of the valve to the left. Hot gas from the compressor 1 is now directed by the valve 2 to the heat exchanger 3 which operates as a condenser heating the inside of the building. From the heat exchanger 3 the now liquid refrigerant enters the valve 2, where it is directed to the expansion device 5 positioned upstream of the heat exchanger 4. In the expansion device the pressure and temperature of the liquid refrigerant are reduced and the refrigerant enters the heat exchanger 4 where it evaporates at a low pressure and temperature, absorbing the heat from outside air. Evaporated refrigerant is directed by the valve 2 to the suction pipe of the compressor 1 and the cycle is repeated.

I claim:

1. A heat pump comprising:

a compressor for refrigerant gas;

a selective connecting means;

a first heat exchanger having an inlet and an outlet;

a first pair of conduits connected between said selective connecting means and said first heat exchanger inlet, one of said conduits containing an expansion device for refrigerant fluid travelling therein toward said first heat exchanger;

a second heat exchanger having an inlet and an outlet;

a second pair of conduits connected between said selective connecting means and said second heat exchanger inlet, one of said conduits containing an expansion device for refrigerant fluid travelling therein toward said second heat exchanger; and said selective connecting means comprising means for selectively connecting:

the outlet of said compressor to the other conduit to a selected one of said heat exchangers; and the outlet of the other of said heat exchangers to the input of said compressor, while connecting the outlet of said selected heat exchanger to the conduit containing the expansion device at the inlet of the other heat exchanger while closing the then unused conduit connected to each heat exchanger inlet, said selective connecting means including means for reversing the roles of the heat exchangers.

2. A heat pump is claimed in claim 1 wherein the inlet port of each heat exchanger is higher than the output port.

* * * * *